US006260723B1

(12) United States Patent
Bergholtz

(10) Patent No.: US 6,260,723 B1
(45) Date of Patent: Jul. 17, 2001

(54) PACKAGE FOR FLOWABLE MEDIA HAVING A SNAP LID AND PREFORM FOR MAKING SAME

(75) Inventor: Lars Bergholtz, Höganäs (SE)

(73) Assignee: Tetra-Laval Holdings & Finance

( * ) Notice: Subject to any disclaimer, the term of this patent is extended or adjusted under 35 U.S.C. 154(b) by 0 days.

(21) Appl. No.: 09/297,253

(22) PCT Filed: Oct. 1, 1997

(86) PCT No.: PCT/EP97/05387

§ 371 Date: Jun. 23, 1999

§ 102(e) Date: Jun. 23, 1999

(87) PCT Pub. No.: WO98/19930

PCT Pub. Date: May 14, 1998

(30) Foreign Application Priority Data

Nov. 2, 1996 (DE) ..... 196 45 263

(51) Int. Cl.[7] ..... B65D 53/00

(52) U.S. Cl. ..... 215/344; 215/250; 215/43; 215/341; 215/321; 215/320; 215/354; 220/789; 222/153.06; 222/570

(58) Field of Search ..... 220/675, 780, 220/789, FOR 100, FOR 101, 659; 215/344, 343, 354, 321, 320, 43, 250, 317, 341, 256; 222/153.06, 562, 570

(56) References Cited

U.S. PATENT DOCUMENTS

| | | | | |
|---|---|---|---|---|
| 1,747,760 | * | 2/1930 | Duffy et al. | 215/320 |
| 2,228,936 | * | 1/1941 | Walter | 215/320 X |
| 2,754,866 | | 7/1956 | Coltman, Jr. . | |
| 2,776,691 | * | 1/1957 | Tupper | 220/780 |
| 2,852,054 | * | 9/1958 | Motley | 215/45 X |
| 3,032,225 | * | 5/1962 | Harding | 215/354 |
| 3,074,579 | * | 1/1963 | Miller | 215/344 |
| 3,096,897 | * | 7/1963 | Hansen | 215/321 X |
| 3,117,702 | * | 1/1964 | Henchert . | |
| 3,137,748 | * | 6/1964 | Makowski . | |
| 3,352,448 | * | 11/1967 | Livingstone | 220/790 X |
| 3,392,860 | * | 7/1968 | Faulstich | 215/354 |
| 3,428,208 | * | 2/1969 | Kosar . | |
| 3,568,871 | * | 3/1971 | Livingstone | 215/344 |
| 3,572,413 | * | 3/1971 | Livingstone | 215/354 |
| 3,616,955 | * | 11/1971 | Heffran | 215/321 X |

(List continued on next page.)

FOREIGN PATENT DOCUMENTS

| | | | |
|---|---|---|---|
| 313159 | | 2/1974 | (AT) . |
| 2624794 | | 12/1976 | (DE) . |
| 4522396 | | 3/1993 | (DE) . |
| 9412883 | | 11/1994 | (DE) . |
| 958417 | * | 5/1964 | (GB) ..... 215/343 |

* cited by examiner

*Primary Examiner*—Allan N. Shoap
*Assistant Examiner*—Robin A. Hylton
(74) *Attorney, Agent, or Firm*—Robert L. Showalter; Michael L. Dunn

(57) ABSTRACT

A package for flowable media and a snap lid which package and snap lid are both made from thermoplastic material, in which a collar-shaped head of the package surrounds a pouring aperture of the package, which collar-shaped head has a retaining ring on its outside, an inside annular surface, and an upper end having an edge with a snap catch, which upper end can be closed using the snap lid. The snap lid has a closing wall from which an annular sealing lip projects towards an inside of the package, and can be brought into contact with an inside surface of the edge in sealing engagement. The closing wall is provided with an outside catch for snap engagement with a snap catch of the edge of the head. The head of the package widens outwards and upwards at its edge, and both the inner surface of this edge and an outer surface of the sealing lip on the snap lid are curved convexly relative to each other. The invention also includes preforms for making the package of the invention.

6 Claims, 3 Drawing Sheets

U.S. PATENT DOCUMENTS

Figure 1:
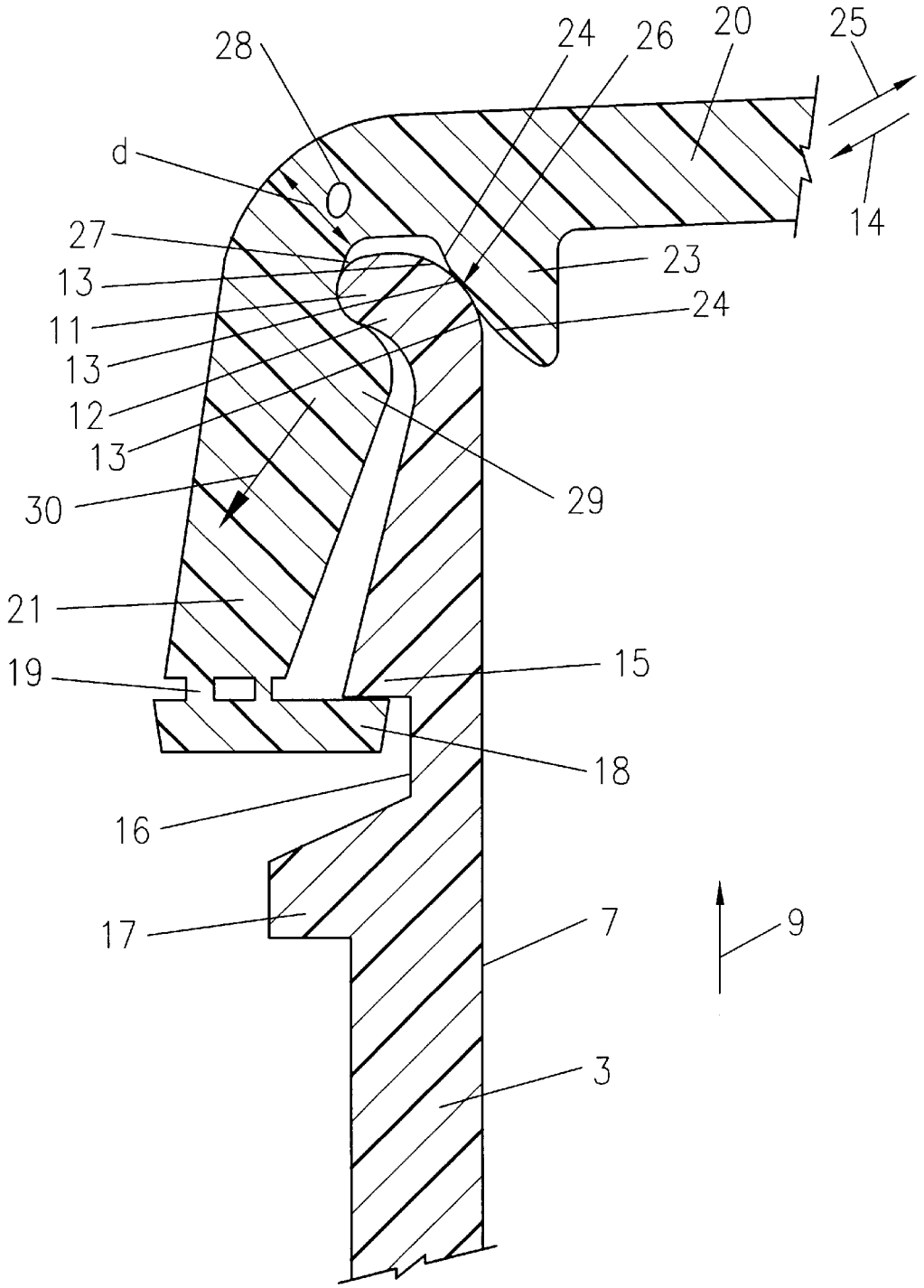

| | | | | |
|---|---|---|---|---|
| 3,817,418 | * | 6/1974 | Mastrovito | 215/344 X |
| 3,869,059 | * | 3/1975 | Ellis | 215/320 |
| 3,907,146 | * | 9/1975 | Fields | 215/344 X |
| 3,979,002 | * | 9/1976 | Faulstich | 215/256 |
| 4,061,239 | | 12/1977 | Tasseron . | |
| 4,133,441 | * | 1/1979 | Mittleman et al. | 215/320 X |
| 4,180,178 | * | 12/1979 | Turner | 220/780 X |
| 4,187,953 | * | 2/1980 | Turner | 215/321 X |
| 4,279,352 | * | 7/1981 | Ward | 215/321 X |
| 4,281,774 | * | 8/1981 | Mumford | 215/256 X |
| 4,387,819 | * | 6/1983 | Corsette | 215/344 X |
| 4,406,854 | * | 9/1983 | Yoshino | 215/44 X |
| 4,534,484 | * | 8/1985 | Deland | 215/354 X |
| 4,561,562 | * | 12/1985 | Trombly . | |
| 4,687,114 | * | 8/1987 | Crisci | 215/344 |
| 4,785,948 | * | 11/1988 | Strassheimer | 220/675 X |
| 4,858,776 | * | 8/1989 | Mehara | 215/341 X |
| 4,885,197 | * | 12/1989 | Strassheimer | 220/675 X |
| 4,971,213 | * | 11/1990 | Ishinabe et al. | 215/344 |
| 5,009,323 | * | 4/1991 | Montgomery et al. | 215/343 X |
| 5,012,970 | * | 5/1991 | Kucherer . | |
| 5,126,177 | * | 6/1992 | Stenger | 220/675 X |
| 5,217,128 | * | 6/1993 | Stenger | 215/42 X |
| 5,292,243 | * | 3/1994 | Gibbemeyer . | |
| 5,379,910 | * | 1/1995 | Montgomery | 215/344 X |
| 5,421,470 | * | 6/1995 | Dudzik | 215/343 X |
| 5,489,036 | * | 2/1996 | Arkins | 215/343 |
| 5,738,231 | * | 4/1998 | Montgomery | 215/344 X |
| 5,829,608 | * | 11/1998 | Clerget | 215/343 X |
| 5,839,596 | * | 11/1998 | Zahn et al. . | |
| 6,079,579 | * | 6/2000 | De Cuyper | 215/256 X |
| 6,082,567 | * | 7/2000 | Bietzer et al. | 215/256 |

* cited by examiner

PACKAGE FOR FLOWABLE MEDIA HAVING A SNAP LID AND PREFORM FOR MAKING SAME

The invention relates to a package for flowable media with a snap lid, both of which are made from thermoplastic material, in which the collar-shaped head surrounds a pouring aperture, which has on the outside a retaining ring, on the inside an approximately annular internal surface, at the top at the free end an edge with a snap catch and which can be closed by means of the snap lid, from the inside of the closing wall of which an annular sealing lip projects towards the inside of the package, and can be brought into contact with the inside surface of the edge in a sealing engagement, and which has an outside catch for snap engagement with the edge of the head.

The invention also relates to an injection moulded blank for manufacturing a package for flowable media from thermoplastic material, in which the collar-shaped head surrounds a pouring aperture, and has on the outside a retaining ring, on the inside an approximately annular internal surface, and at the top at the free end an edge with a snap catch.

Injection moulded blanks made from plastics, in particular from polyethylene terephthalate (PET) are known. With blanks, and the packages formed from them, for example, bottles, a distinction is made between three different areas, namely the bottle head, the body and the base. The bottle head is also often moulded with a thread and with sealing surfaces. The bottle later inflated and filled is then closed with a screw lid. For aseptic closures, the screw lid either has on it sealing inserts, for example, foils, or the screw caps are moulded with special sealing lips which seal onto the cylindrical inside of the bottle head or onto the bottle edge.

Plastics snap closures are also known which also seal onto the inside of the mouth of the bottle. These snap closures are fitted, for example, when dealing with still mineral waters. Known snap lids of this type have a snap edge lying on the outside with a tapered seal lying on the inside. In this case the inside of the cylindrical head of the blank or of the bottle has no curvature along the axis of the cylinder.

Although in this way a seal is obtained with respect to liquids such as, for example, water or the like, with a low degree of capillary action, it is not obtained with respect to methanol or, for example, helium. Helium, as the smallest sized chemical element, is particularly well suited as a measuring medium for testing sealing. If an aseptically sealed closure is desired on a package for flowable media, such measuring methods can be used.

The object of the invention is to provide a package for flowable media of the type described in the introduction, the head of which can be closed in an aseptically sealed manner with the snap lid; and the provision of an injection-moulded blank, as already described hereinabove, from which a package of the type described can be manufactured, wherein the head on the blank is not altered during the process of manufacturing the package.

In accordance with the invention, the object is solved with respect to the package for flowable media in that the head of the package widens radially outwards and upwards at its edge, and both the inner surface of this edge and the outer surface of the sealing lip on the snap lid are curved convexly in the direction of view towards these two surfaces. It is firstly to be explained that the pouring aperture and thereby the head of the package is arranged on the side of the package opposite the base on which it stands, namely "at the top". The free end of the head is thus located at the top, where the edge with the snap catch described is arranged. On the upper free end, the pouring aperture can be closed by means of the snap lid described, which in cross-section has substantially a U-shape, wherein the segment joining the two free legs of the U is the projection onto the closing wall.

Corresponding to the generally circular configuration of the pouring aperture, the closing wall is a flat, round disc which preferably is substantially planar. Onto its annular periphery an outer ring is connected by means of a curve, which ring provides enclosure of the edge of the head. The outer ring can be tilted slightly with respect to the edge of the head, for example, at an angle of 5 to 10°, preferably approximately 20°. At the outer lower end of the outer ring a closure safety device is fitted, which optionally provides retention of the snap lid on the head by means of a catch on the head of the package.

Such a snap lid is clamped onto the edge of the package and can be snapped into place particularly well at its free end in that the head of the package widens outwardly and upwardly. The diameter of the edge is thus on average greater at the upper free end of the head of the package than the diameter of the pouring aperture.

This radial widening of the edge outwards and upwards provides for an inner surface of the edge. Looking towards this, the curvature is convex.

If the snap lid is viewed, and if seen from inside towards its closing wall, the sealing lip is projecting from the closing wall opposite to the direction of viewing, that is to say inwards, is then evident. The diameter of this is determined in relation to the centre of the snap lid from the outer surface of the widening edge of the package head. The edge and the sealing lip should namely be brought into mutual sealing engagement with one another. With this, the outer surface of the sealing lip plays a particular role, and according to the invention it is curved such that it appears convexly curved when viewed at an angle from outside towards the outer surface of the sealing lip. The curvature of the inner surface of the edge on the head and the curvature of the outer surface of the sealing lip on the snap lid are thus curved in opposite directions to one another. These two surfaces come to lie on top of one another when the snap lid closed, and, in accordance with the teaching of the invention, by means of the convex curvatures a sealing line is produced. In other words in cross section along the pouring aperture, the two curved lines touch at a point. This point is the projection of the line which extends along the sealing lip or along the edge of the head. This linear touching allows the aseptically sealed closure of the head with the snap lid described.

Bacteria and spores are generally a magnitude larger than helium atoms and can thus pass through a helium tight seal less than helium atoms. Two criteria have been established for defining aseptic sealing according to the invention: The first criterion requires sealing against helium. The second criterion for an aseptically sealed closure necessitates the sealing surfaces being sterilisable. An aseptically sealed closure within the meaning of the teaching according to the invention is thus a closure sealed at least with respect to methanol, preferably even sealed with respect to helium. This condition is ensured by the solution according to the invention.

It is also particularly advantageous when in addition the sealing surfaces of the aseptically sealed closure can be sterilised well. This is ensured particularly well, inter alia, when the surfaces of both the edge of the head and of the snap lid facing towards the inside of the pouring aperture have surfaces which are as smooth as possible. In accordance with the invention, this is provided in that the surfaces facing towards the inside of the package have no, or almost no, undercuts. The sterilising processes then work particularly well. The skilled person understands that an edge widening radially outwards and upwards on the one hand, and a snap lid with a sealing lip projecting downwards on the other hand make possible smooth surfaces without undercuts.

The sealing between the head of the package and the snap lid is, in the case of the invention, tested by means of two different mechanisms, which will be referred to hereinafter as macrological sealing and micrological sealing. It may be sufficient when the micrological sealing is measured and obtained, for the sealing of a head of a package of the type described here with a snap lid to be described as aseptic.

With the micrological sealing, care is taken that as much compressive strain as possible is concentrated in one point and consequently reliable aseptic sealing occurs at this point and on the corresponding line of maximum compressive strain. In accordance with the invention, series of tests were carried out which showed that a high concentration of strain on just one line of the sealing surface, as described hereinabove, leads to better sealing properties than the distribution of the contact pressure on several bearing lines. By means of the convex curvatures of the sealing surface lying on top of one another, these strain concentrations are advantageously produced on a single line.

In a further advantageous embodiment of the invention, the snap lid is provided on its inside with an annular snap chamfer surrounding the sealing lip, engaging over the edge of the head, and the thickness of the snap lid is smaller in the direction outside and above the snap chamfer than in the area of the outer catch. Where the closing wall of the snap lid terminates outside, and by means of a curvature merges into the outside ring described, there is located internally the snap chamfer, which can engage over the edge of the head, when the snap lid has been pressed onto the head of the package. In precisely this area of transition between the upper closing wall and the lateral outside ring of the snap lid, the thickness of the material is reduced according to the invention such that it is less than the thickness of the material in the area of the outer catch, which—without the head of the package being located between them—lies opposite the outer surface of the sealing lip. In the area of this outer catch and/or in the area of the sealing lip, according to the invention the wall thickness is selected to be greater than in the previously described transition area. Where the thickness of the material is greater, the snap lid has a greater degree of stiffness. If according to the invention in the area outside and above the snap chamfer, that is to say in the wall outside the snap chamfer, the thickness of the material is now reduced, a lesser degree of stiffness is produced, and a line about which, as about an axis, the outer ring of the snap lid can be curved with respect to its closing wall. Again, in cross-section along the pouring aperture, this line of bending is represented as a point about which the outer ring can rotate. In vertical section, in other words, according to the invention a point of rotation is created in the transition area between the closing wall the outer ring of the snap lid, by means of which possibilities for compensating for faulty mouldings of the parts which are to be brought together in sealing engagement are provided, which with conventional closures was unknown until now.

In this way, the second criterion for sealing, that in addition to the micrological, a macrological sealing is provided, can also be satisfied according to the invention. With macrological sealing, larger moulding faults of the snap lid or of the head of the package are compensated for, such as, for example, non-roundness or warping. Between the sealing lip moulded onto the closing wall of the snap lid on the one hand, and the outside catch of the snap lid moulded onto the top of the outer ring on the other hand, the compensating line of rotation is produced (in vertical section, a point of rotation), which gives both the sealing lip and the outside catch enough play to thereby reliably compensate for the possible faults in the snap lid and package head dimensions described. As the snap lid is manufactured from comparatively soft plastics, and the high degree of strength of the material in the area of the outside catch and also in the area of the sealing lip results in a relatively rigid behaviour, the rotation line results from tapering the material in the area described hereinabove. The macrological sealing is responsible, in addition to compensating for faults in dimensions, for the function of providing suitable tensile and compressive forces for the secure seating of the snap lid on the head of the package and for the contact pressure of the sealing lip.

It is furthermore advantageous according to the invention when in cross-section along the pouring aperture, the radius of curvature of the inner surface of the edge of the package head decreases from the inside of the package towards the outside to the free end, thus preferably reduces from infinity to 0.5 mm. Proceeding from the uncurved cylindrical wall facing further towards inside of the package, which thus has an infinitely large radius of curvature, the sealing properties have proved very advantageous when the radius of curvature decreases outwards towards the free end. In a similar manner, it is advantageous when according to the invention in cross-section along the pouring aperture the radius of curvature of the outer surface of the sealing lip on the snap lid is in the region of 0.2 mm to 2 mm. The area with the strongest curvature is thus on the surface where it has a radius of curvature of only 0.2 mm; while the area of the weakest curvature has a radius of preferably approximately 2 mm. According to the invention it is further provided that advantageously the convexly curved inner surface in the area of the edge of the head and the outer surface of the sealing lip convexly curved opposite to this have a low degree of roughness for high surface quality and are configured without raised portions. The manufacturing tools for pouring the blanks when bottles are blown from these, often have mould seams which lie in the mould separation planes. The workpiece produced from this then often has beads, small ribs or knobs which develop as raised portions. In accordance with the invention the manufacturing tool is now configured such that, to the extent that they are needed at all on the tool, such mould seams are not located in the opposite curved surfaces described. In this way smooth sealing surfaces and an optimal sealing are obtained. Advantageously the tools for the manufacture of these convexly curved surfaces can be mirror polished. In this way a high surface quality is obtained, whereby the sealing is further improved.

In order to obtain a good and reliable seal, it is further advantageous when according to the invention the snap lid is composed of a softer thermoplastic material than the head of the package, preferably from amorphous polypropylene. When the package for flowable media is blown from a blank, it is advantageous when this blank is composed, for example, from PET, APET or PETG.

The object of providing an injection moulded blank, with the head of which an aseptically sealed closure by means of a snap lid of the type described hereinabove can be obtained, is solved according to the invention in that the head of the blank is widened radially outwards and upwards at its edge, and the inner surface of this edge is convexly curved when viewed towards it. Although the purpose of the manufacturing and configuration of the blank according to the invention is also the manufacturing of a package for flowable media, and the aseptically sealed closure thereof with a snap lid. Prior to the manufacture of the package for flowable media itself, there is no need to refer to the snap lid, but nevertheless it is advantageous to comply with the measures described in order to then obtain the same advantages as in connection with the completed package for flowable media. Reference is therefore made to the explanations of the corresponding configuration of the package for flowable media which also apply in the case of the blanks. The configuration and arrangement of the snap lid thus play an important role again, so a corresponding applicability will also be provided for the blank.

In a similar manner, reference is made to the explanations hereinabove for moulding the radii of curvature and the roughness of the surfaces, when it is taken into consideration with the injection moulded blank that according to the invention in cross-section along the pouring aperture the radius of curvature of the inner surface of the edge of the head of the blank decreases from the inside of the blank outwards to the free end, preferably reducing from infinity to 0.5 mm. The same is the case with the advantageous configuration of the injection moulded blank, wherein according to the invention, to obtain a high surface quality, the convexly curved inner surface has, in the area of the edge of the head, a low degree of roughness without raised portions.

As with the package for flowable media itself, the injection moulded blank can be formed from polyethylene terephthalate (PET).

The snap lid, on the other hand, to which reference is made only indirectly, namely with respect to the manufacturing of the package fro flowable media of the type described in the introduction, can be made from the following material:

PP random copolymer type 3300 MC type from BASF

PP random block copolymer type NX 40036 from BASF

PE metallocene type Luflex 1712SX from BASF

LDPE type 1200MN18 from ELFATO

LDPE type 1700MN 18 from ELFATO, and

PP moplen EP-C57MA from Montel.

With the head moulded according to the invention of both the blank and of the package for flowable media of the type described hereinabove, the quantity of material used for aseptically closeable packages can advantageously be reduced. By omitting a thread, the wall thickness of the head can be made thinner. Compared to a conventional blank with a threaded head, which weighs approximately 50 g, with the blank according to the invention, 6 g of PET is saved.

A further advantage of the blank head moulded according to the invention is the functional division into macrological sealing and micrological sealing. In this way large fault tolerances are reliably compensated for, which can occur when the package is moulded. As the bearing point or bearing line of the micrological seal on the curved inner surface of the package head can travel both in the axial and radial direction over a wide area, even large fault tolerances can be reliably compensated for. A typical order of magnitude of fault tolerance which occurs with a package head external diameter of 34 mm is +/−0.1–0.2 mm.

The packages formed using the package head according to the invention can be filled with drinks with a low carbon dioxide content. The internal pressure of a filled package, for example a PET bottle, is advantageously in the range of 1 bar to 4 bar.

Figure 3:
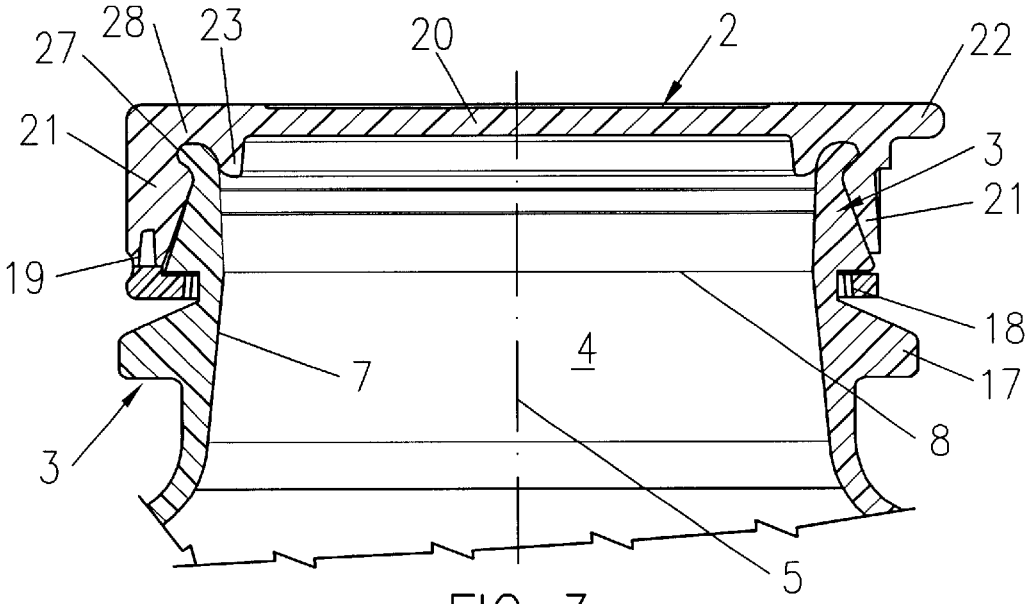
Figure 2:
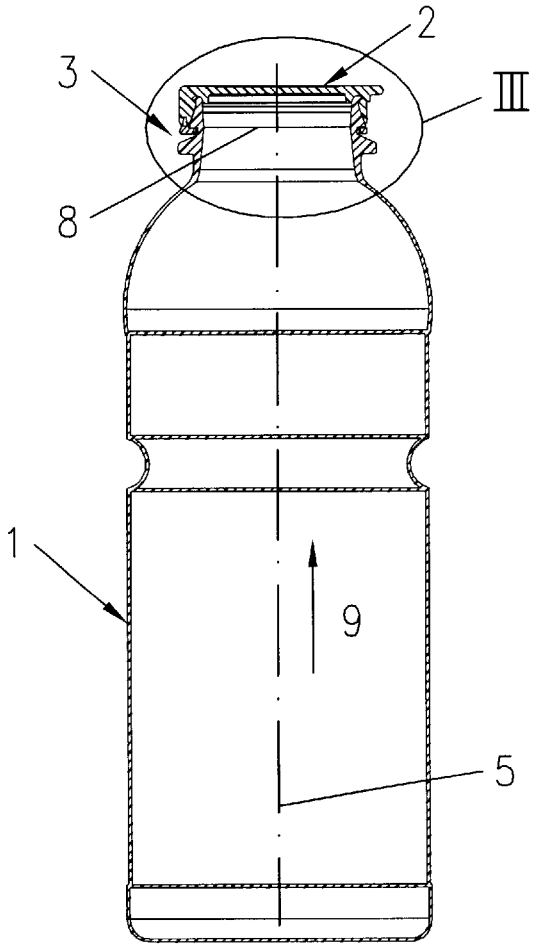
Figure 4:
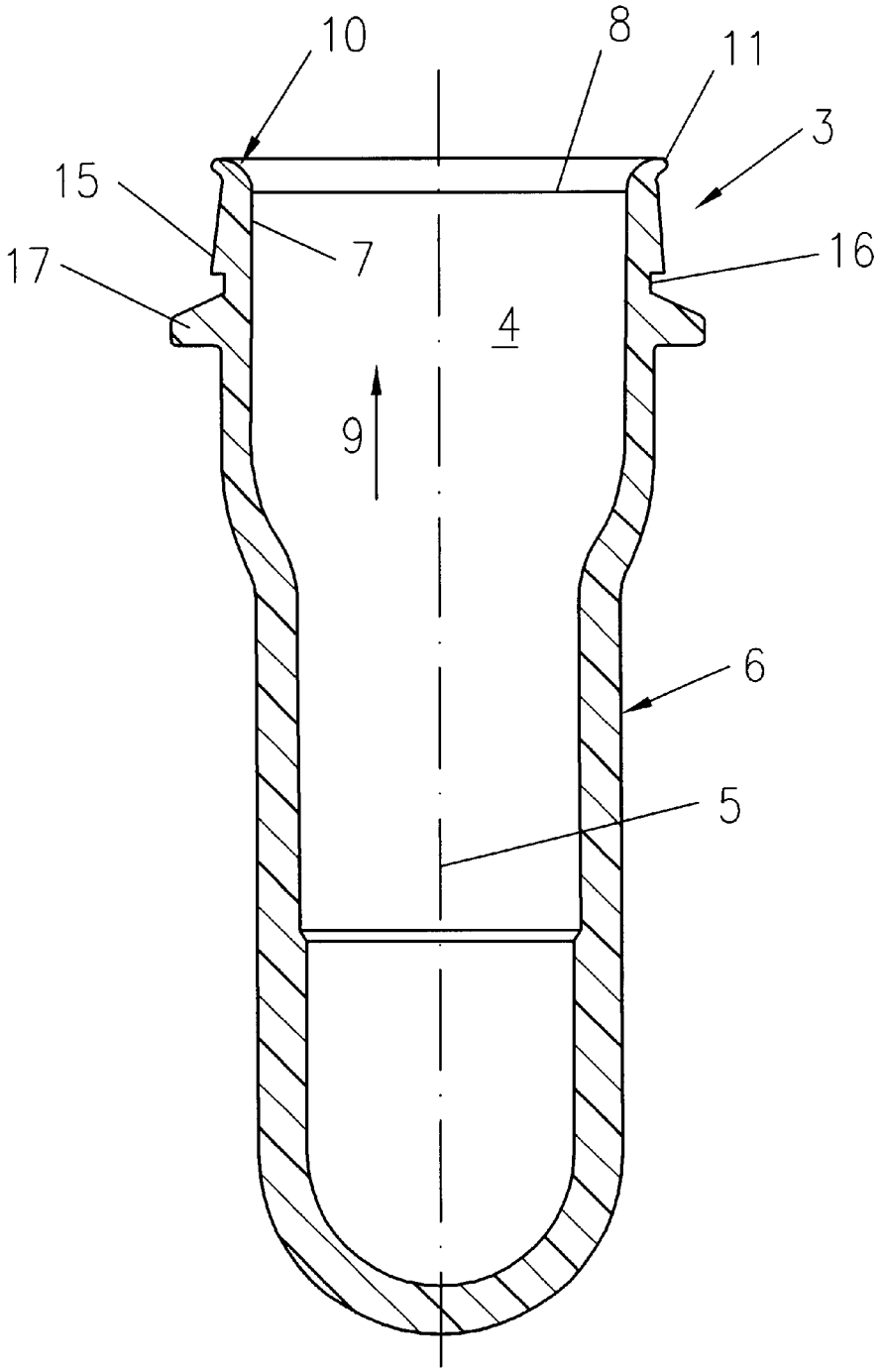

Further advantages, features and possibilities for application of the present invention will be evident from the following description of preferred embodiments with reference to the attached drawings. In these is shown in:

FIG. 1 cut away and enlarged, a cross-section view along the pouring aperture, wherein only the hinge side end of the snap lid shown placed in sealing engagement on the head of the package is represented, FIG. 2 a package for flowable media with the head and snap lid configured according to the invention, wherein the package is represented here as a PET bottle, FIG. 3 a part of the package head shown cut away and enlarged with the snap lid placed on it according to the detail III in FIG. 2, and FIG. 4 an injection moulded blank, which in the upper area has the same configuration as shown enlarged in FIGS. 1 and 3 for the completed blown bottle.

The package for flowable media 1, in this case a PET bottle, shown in FIG. 2, has on its upper end a collar shaped head 3 closed with a snap lid 2. Said head surrounds a pouring aperture 4. The cross-sectional views in the drawings are taken through the longitudinal central axis 5 of the package for flowable media 1 and of the injection moulded blank 6 according to FIG. 4. The pouring aperture 4 is surrounded by the annular inner surface 7 arranged inside the head 3. This can be configured substantially cylindrically in the lower area of the pouring aperture 4, namely towards the inside of the package 1 and the blank 6. For reasons of simplicity, in the schematic representation of FIG. 1, the shape of this inner surface 7 is approximately cylindrical, while this inner surface 7 runs to approximately half height (line 8) in a tapering manner in the shape of a truncated cone in the embodiments according to FIGS. 2 to 4 in the neck area of the package, that is to say in the area of the head 3; and thereafter in the direction of the arrow 9 seen further up, above the centre height 8 is configured slightly widening upwards in a truncated cone shape. At the free upper end 10 of the head 3 there is moulded an edge 11 widening radially outwards and upwards—to a greater degree compared to that which has just been described—forming a snap catch 12. The inner surface 13 of this edge 11 is consequently configured curved upwards and outwards. When viewed in the direction of the normal according to arrow 14 (FIG. 1) from an angle from above towards this inner surface 13 of the edge 11, the curvature appears convex. Further, as seen in FIG. 1, in a direction toward the outer surface of edge 11, the edge also appears convex.

The head 3 of the package 1 and of the blank 6 is provided on the outside below the edge 11 with a catch 15 which, being a projection delimits the top of an outer groove 16. The latter is delimited at the bottom by a retaining ring 17 projecting outwards. The same layout is found on both the head 3 of the package for flowable media 1 and the head 3 of the blank 6.

In the annular outer groove 16 of the head 3 perpendicular to the longitudinal central axis 5 there engages a safety closure 18 for the snap lid 2. This safety closure 18 forms a visual safety means for the consumer when the package is filled and closed, which indicates the initial opening of the package, in that pre-determined breakage points 19 of the safety closure 18 break when the snap lid is opened for the first time.

Apart from this safety closure 18, the snap lid 2 generally has the shape of a cup, which is clamped onto the head 3 with the opening facing down, with a U-shaped cross-section. At the top the snap lid 2 then has the substantially planar closing wall 20. To this, on the outside, an approximately cylindrical outer ring 21 is connected, which is articulated in a hinged manner opposite to the opening gripper 22, wherein the hinge is in part only formed by the predetermined breakage points 19, and does not play any particular role. After repeated opening, the pre-determined breakage points 19 can also break in this area opposite the gripper 22, so the snap lid 2 can be removed completely after repeated openings.

From the closing wall 20 of the snap lid 2 an annular sealing lip 23 projects towards the interior of the package 1. The radial outer surface 24 of this sealing lip 23 is configured bulging from the centre radially outwards. The cross-section shown in the cross-sectional representations (along the pouring aperture 4 and the longitudinal central axis 5) shows a curvature which according to FIGS. 1 to 3 is opposite the curvature of the inner surface 13 of the edge 11. These are thus opposite curvatures. If viewed in the direction of the arrow 25 (opposite the arrow 14), in the direction of the normals towards this curved, bulging surface 24 of the sealing lip 23, it appears convex. The surfaces 13 and 24 are thus opposite, convexly curved surfaces. These two touch each other in the representation of FIGS. 1 to 3 in a point 26, which is an annular line 26 in the three-dimensional body.

In the transition area between the closing wall 20 and the outer ring 21, the snap lid 2 is provided with a snap chamfer 27. Radially outwards and at an angle upwards, the material of the snap lid 2 is configured with a thickness d, which is less than the thickness of the closing wall 20, with the result that in the snap lid 2 an annular rotation line 28 is produced, which is shown for clarity in FIG. 1 as a point. This point of rotation and the rotation line 28 is an element of the macrological sealing described hereinabove. The snap chamfer 27 makes possible, in cooperation with a bead-shaped outer catch 29 configured below it inside the outer ring 21, and the snap catch 12 of the head 3, secure closing of the snap lid 2 on the head 3. FIG. 1 shows schematically, by means of the imaginary arrow 30 indicating force, the closing force with which the two curved surfaces 13 and 24 are pressed onto one another at the point where they touch (line 26). These sealing surfaces 13 and 24 are always curved convexly with respect to one another. The bearing point (line 26), is thus always produced in a precisely defined manner for the micrological sealing also described hereinabove. This line 26 can travel over the curved sealing surfaces 13 and 24 and thereby compensate for dimensional inaccuracies caused by manufacturing faults through heat expansion. During transport and the storage the filled packages are often exposed to different temperatures. Sometimes the packages stand in the blazing sun, another time in a cold store. The micrological sealing of the novel snap closure offers increased protection against leakage in that the bearing line 26 can travel over the curved inner surface 13 of the edge 11, and thereby can compensate for heat expansion. This also makes possible increased protection from leakage which could result from manufacturing tolerances in the blank 6, as shown in FIG. 4, the snap lid 2, or the package 1 moulded by inflation (PET bottle). Leakages caused by shaking are also optimally prevented in this way.

An inflatable blank 6 with the novel head 3 is shown in FIG. 4. The inner surface 13 on the edge 11 is moulded with a mirror-polished injection moulding tool. Such tools can be made in particular in that in the area of this inner surface 13 which forms the curved sealing surface of the head 3, there are no mould seams.

What is claimed is:

1. A package for flowable media and a snap lid (2), which package and snap lid are both made from thermoplastic material, in which a collar-shaped head (3) of the package surrounds a pouring aperture (4) of the package, which collar shaped head has a retaining ring (17) on its outside, an inside annular surface (7), and an upper end (10) having an edge (11) with a snap catch (12) which upper end is closed by means of the snap lid (2), said snap lid (2) having a closing wall (20) from which an annular sealing lip (23) projects towards an inside of the package (1), and is brought into contact with an inside surface (13) of the edge (11) in sealing engagement, said closing wall (20) being provided with an outside catch (29) for snap engagement with a snap catch (12) of the edge (11) of the head (3) wherein the head (3) of the package (1) widens outwards and upwards at its edge (11), and both the inner surface (13) of this edge (11) and an outer surface (24) of the sealing lip (23) on the snap lid (2) are curved convexly relative to each other in an engaged and a disengaged position between the lid and the package.

2. A package according to claim 1, characterised in that the snap lid (2) is provided on its inside with an annular snap chamfer (27) surrounding the sealing lip (23), engaging over the edge (11) of the head (3), and that the thickness (d) of the snap lid (2) is smaller in the direction outside and above the snap chamfer (27) than in the area of the outer catch (29).

3. A package according to claim 1, characterised in that in cross-section along the pouring aperture (4) the radius of curvature of the inner surface (13) of the edge (11) of the package head (3) decreases from the inside of the package (1) outwards to the free end (10), preferably reducing from infinity to 0.5 mm.

4. A package according to claim 1, characterised in that in cross-section along the pouring aperture (4) the radius of curvature of the outer surface (24) of the sealing lip (23) on the snap lid (2) is in the range of 0.2 mm to 2 mm.

5. A package according to claim 1, characterised in that the convexly curved inner surface (13) in the area of the edge of the head (3) and the convexly curved outer surface (24) of the sealing lip (23) opposite this have a low degree of roughness to provide a high quality surface, and are configured without raised portions.

6. A package according to claim 1, characterised in that the snap lid (2) is made from a softer thermoplastic material than the head (3) of the package (1).

* * * * *